US007946307B2

(12) United States Patent
Zheng

(10) Patent No.: US 7,946,307 B2
(45) Date of Patent: May 24, 2011

(54) COLLAPSIBLE STRUCTURES WITH WATER DELIVERY

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 12/005,026

(22) Filed: Dec. 21, 2007

(65) Prior Publication Data

US 2009/0159109 A1 Jun. 25, 2009

(51) Int. Cl.
*E04H 15/02* (2006.01)
*E04H 15/40* (2006.01)
*E04H 15/44* (2006.01)

(52) U.S. Cl. ..... 135/96; 135/126; 135/128

(58) Field of Classification Search ..... 135/96, 135/125, 126, 128, 91, 902; 47/21.1; 446/153, 446/475, 478; 472/117, 128; 4/599, 600, 4/601; 134/123, 198, 199
See application file for complete search history.

(56) References Cited

U.S. PATENT DOCUMENTS

| | | | | | |
|---|---|---|---|---|---|
| 2,940,466 | A * | 6/1960 | Speights | 137/356 |
| 4,556,391 | A * | 12/1985 | Tardivel et al. | 446/7 |
| 5,779,240 | A * | 7/1998 | Santella | 273/349 |
| 5,820,472 | A * | 10/1998 | Briggs | 472/128 |
| 5,970,536 | A * | 10/1999 | Suarez | 4/599 |
| 6,006,772 | A * | 12/1999 | Zheng | 135/126 |
| 6,024,264 | A * | 2/2000 | Java | 224/576 |
| 6,050,872 | A * | 4/2000 | Cahill et al. | 446/89 |
| 6,682,000 | B1 * | 1/2004 | Apple | 239/289 |
| 2003/0074845 | A1 * | 4/2003 | Sample et al. | 52/63 |
| 2004/0050411 | A1 * | 3/2004 | Lawrence | 135/128 |
| 2004/0144858 | A1 * | 7/2004 | Sigler, Jr. | 239/289 |
| 2005/0172987 | A1 * | 8/2005 | Byrnes | 135/33.5 |
| 2005/0279396 | A1 * | 12/2005 | Choi | 135/133 |
| 2008/0006315 | A1 * | 1/2008 | Raniere | 135/91 |
| 2008/0245396 | A1 * | 10/2008 | Fitzgerald | 134/123 |

* cited by examiner

*Primary Examiner* — David Dunn
*Assistant Examiner* — Danielle Jackson
(74) *Attorney, Agent, or Firm* — Raymond Sun

(57) ABSTRACT

A structure has at least one foldable frame member having a folded and an unfolded orientation, with a fabric material covering portions of the frame member to form at least one panel when the frame member is in the unfolded orientation. A water tube is attached to the fabric material and connected to a water supply, and a water outlet is coupled to the water tube.

8 Claims, 5 Drawing Sheets

COLLAPSIBLE STRUCTURES WITH WATER DELIVERY

BACKGROUND OF THE INVENTION

1. Field of the Invention

The present invention relates to collapsible structures, and in particular, to collapsible structures which incorporate the use or delivery of water.

2. Description of the Prior Art

There are presently many collapsible structures that are being provided for use by children and adults in a number of different applications. Examples of these collapsible structures are illustrated in the following patents: U.S. Pat. Nos. 5,816,954 (Zheng), 6,006,772 (Zheng), 5,778,915 (Zheng), 5,467,794 (Zheng), 5,975,101 (Zheng), 5,722,446 (Zheng), 4,858,634 (McLeese), 4,825,592 (Norman), 5,964,533 (Ziglar), 5,971,188 (Kellogg et al.), 6,485,344 (Arias), 6,343,391 (LeGette), U.S. Pub. No. 2004/0139997 (Zheng) and U.S. Pat. No. 5,038,812 (Norman), among others. These collapsible structures are supported by one or more frame members that can be twisted and folded to reduce the overall size of the structure. These collapsible structures can be used in a wide variety of applications, such as containers, tents, play structures, executive toys, shelters, sports structures, and others. As a result, collapsible structures have become very popular.

SUMMARY OF THE DISCLOSURE

It is an object of the present invention to provide a collapsible structure that incorporates the use or delivery of water.

In order to accomplish the objects of the present invention, the collapsible structure according to the present invention provides a structure having at least one foldable frame member having a folded and an unfolded orientation, with a fabric material covering portions of the frame member to form at least one panel when the frame member is in the unfolded orientation. A water tube is attached to the fabric material and connected to a water supply, and a water outlet is coupled to the water tube.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
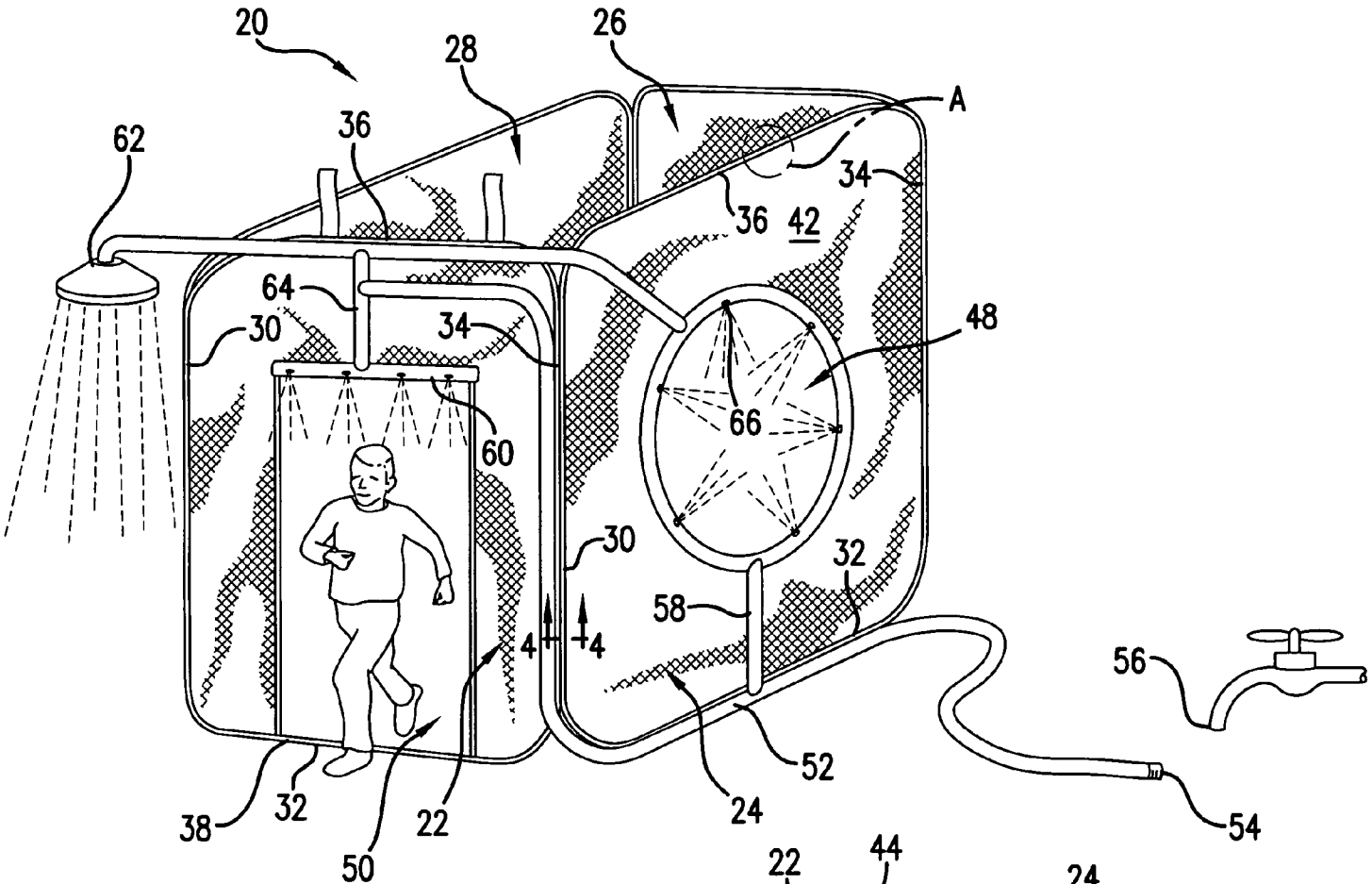
FIG. 1 is a perspective view of a collapsible structure according to one embodiment of the present invention.
Figure 2:
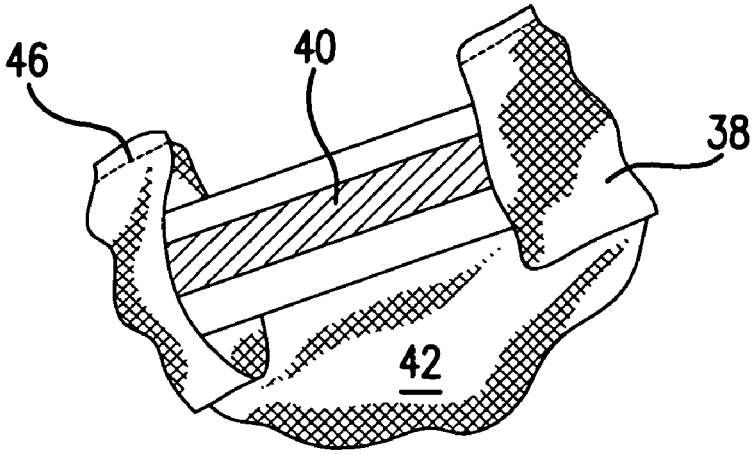
FIG. 2 is a partial cut-away view of the section A of the structure of FIG. 1 illustrating a frame member retained within a sleeve.

As shown in FIGS. 1 and 2, a structure 20 is provided that comprises four panels 22, 24, 26 and 28 connected to each other to encircle an enclosed space. Each panel 22, 24, 26, 28 can have four sides, such as a left side 30, a bottom side 32, a right side 34 and a top side 36, although each panel 22, 24, 26, 28 can assume any configuration and have any number of sides. Each panel 22, 24, 26 and 28 has a frame retaining sleeve 38 provided along and traversing the four edges of its four sides 22, 24, 26, 28. A frame member 40 is retained or held within each respective frame retaining sleeve 38 to support each panel 22, 24, 26, 28. Only the frame member 40 is shown in FIG. 2; the other frame members are not shown but are the same as frame member 40.

The frame members 40 may be provided as one continuous loop, or may comprise a strip of material connected at both ends to form a continuous loop. The frame members 40 are preferably formed of flexible coilable steel, although other materials such as plastics may also be used. The frame members should be made of a material which is relatively strong and yet is flexible to a sufficient degree to allow it to be coiled. Thus, each frame member 40 is capable of assuming two positions or orientations, an open or expanded position such as shown in FIG. 1, or a folded position in which the frame member is collapsed into a size which is much smaller than its open position (see FIG. 3C).

Fabric or sheet material 42 extends across each respective panel 22, 24, 26, 28, and is held taut by the respective frame member 40 when in its open position. The term fabric is to be given its broadest meaning and should be made from strong, lightweight materials and may include woven fabrics, sheet fabrics or even films. The fabric should be water-resistant and durable to withstand the wear and tear associated with rough treatment. The frame members 40 may be merely retained within the respective frame retaining sleeves 38 without being connected thereto. Alternatively, the frame retaining sleeves 38 may be mechanically fastened, stitched, fused, or glued to the respective frame members 40 respectively, to retain them in position.

Figure 4:
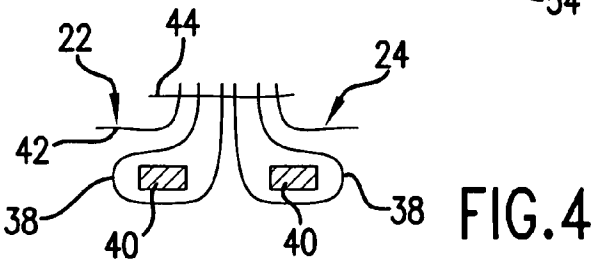
FIG. 4 is a cross-sectional view of the section 4-4 in FIG. 1.

FIG. 4 illustrates one possible connection for connecting adjacent edges of two panels 22 and 24. The fabric pieces 42 are stitched at their edges by a stitching 44 to the respective sleeves 38. Each sleeve 38 may be formed by folding a piece of fabric. The stitching 44 also acts as a hinge for the panels 22 and 24 to be folded upon each other, as explained below. The connections for the three other pairs of adjacent edges may be identical. Thus, the connections on the left side 30 and the right side 34 of each panel 22, 24, 26, 28 act as hinge connections for connecting an adjacent panel.

At the top side 36 and the bottom side 32 of each panel 22, 24, 26, 28, where there is no hinge connection to an adjacent panel, the frame retaining sleeve 38 may be formed by merely folding over the corresponding fabric piece and applying a stitching 46 (see FIG. 2). The fabric piece 42 for the corresponding panel may then be stitched to the sleeve 38.

Openings 48 and 50 may be provided in some or all of the panels 22, 24, 26, 28. These openings 48 and 50 may be of any shape (e.g., triangular, circular, rectangular, square, diamond, etc.) and size and can be designed to allow an individual to pass through them to enter or to exit the structure 20 (among other functions).

A plurality of tubes are provided on one or more of the panels 22, 24, 26, 28 via stitching, glue or similar attachment means, or via removable attachment mechanisms such as hooks, straps, ties, VELCRO™ pads and the like. These tubes can be used to form tube systems for delivering water or other liquids to selected locations or outlets. For example, a tube 52 can have a first end 54 that extends away from the structure 20 for connecting to a water supply 56, such as a water tap or faucet. The intermediate portion of the tube 52 can extend along a bottom side 32 of the panel 24 and then up along the sides 34 and 32 of the panels 22 and 24, respectively, before traversing a portion of the fabric 42 of the panel 22 to a shower outlet 60 positioned above the opening 50. The shower outlet 60 can have a plurality of spray holes to allow water to be sprayed like a mist on to any individual passing through the opening 50. Another tube 58 branches off from the tube 52 along the fabric 42 of the panel 24, then extends around the circular opening 48, and then extends along the top sides 36 of the panels 24 and 22 to a shower head 62. Spray holes 66 can be provided along the circular portion of the tube 58 to allow water to be sprayed like a mist on to any individual passing through the opening 48. A branch of tubing 64 can connect the tubes 52 and 58 along the fabric 42 of the panel 22. Thus, water can be delivered from the supply 56 through the tubes 52, 58 to outlets such as the spray holes 66, shower outlet 60 and shower head 62. This water spraying ability can be both functional and for amusement. For example, the structure 20 can be placed around a sandbox or other location where it might be desirable for the individuals exiting that location to be washed or showered.

The tubes 52, 58, 64 can be made from any conventional soft tubular material that allows water to flow therethrough without leaking. Examples include the materials used for garden hoses, among others. The material is preferably soft and flexible so that the tubes can be folded as the structure 20 is twisted and folded in the manner described below.

While the structure 20 of FIG. 1 is shown and described as having four panels, each having four sides, it will be appreciated that the structure 20 may be made of any number of panels, each having any number of sides, without departing from the spirit and scope of the present invention. For example, each structure may have at least one panel (see FIG. 5 below), and each panel may have three or more sides. Thus, the structures of the present invention may take a variety of external shapes. However, each panel, regardless of its shape, is supported by at least one frame member 40.

Figure 3A:
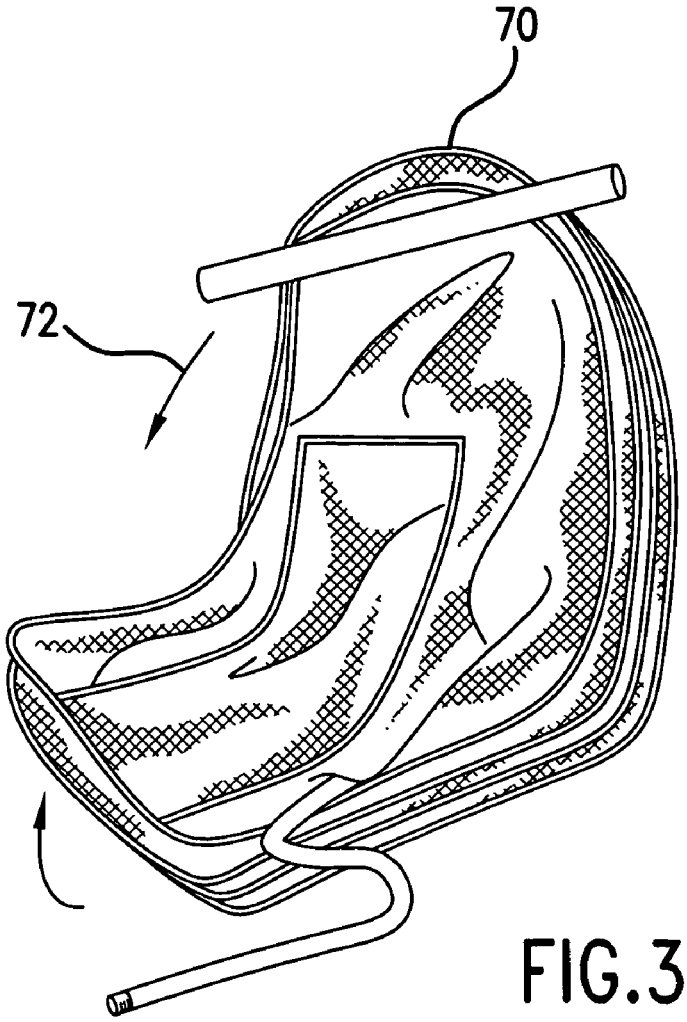
FIGS. 3A through 3C illustrate how the collapsible structure of FIG. 1 may be twisted and folded for compact storage.
Figure 3B:
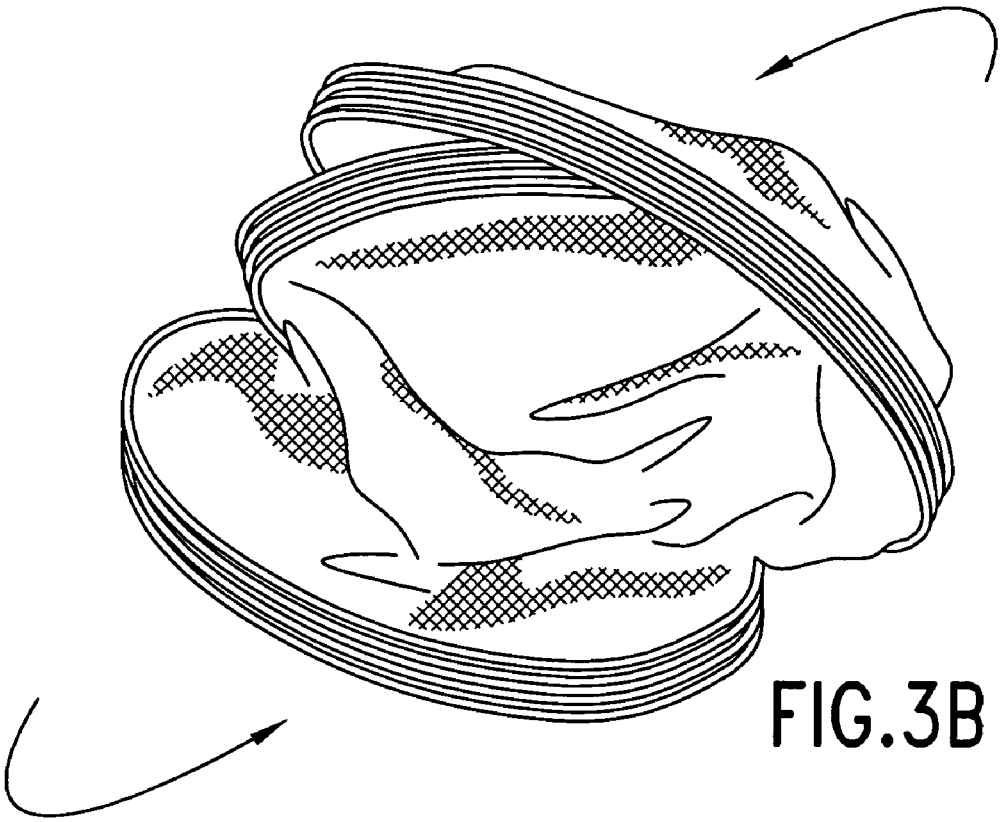
Figure 3C:
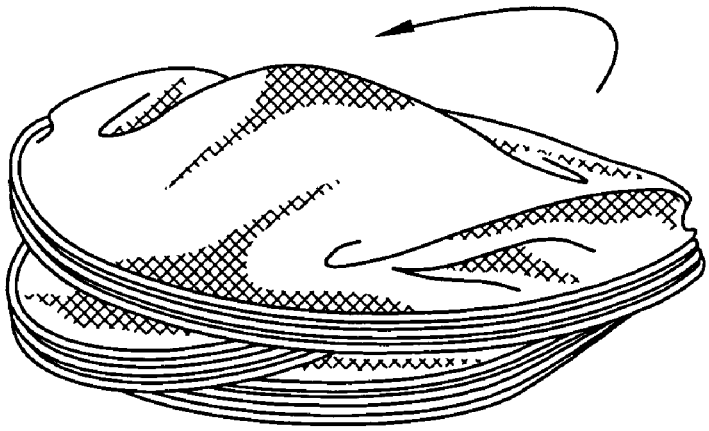

FIGS. 3A through 3C describe the various steps for folding and collapsing the structure 20 of FIG. 1 for storage. The first step consists of pushing panels 22 and 24 towards panels 28 and 26, respectively, about their hinged connections so that panel 22 collapses upon panel 28 and panel 24 collapses upon panel 26. Then, the two panels 22 and 28 are folded so as to be collapsed upon the two panels 24 and 26 to form a stack of four panels, as shown in FIG. 3A. In the second step, the structure 20 is then twisted and folded to collapse the frame members 40 and panels 22, 24, 26, 28 into a smaller shape. In particular, the opposite border 70 of the stack of panels 22, 24, 26, 28 is folded in (see arrow 72 in FIG. 3A) upon the previous fold to further collapse the frame members 40 with the panels. As shown in FIG. 3B, the folding is continued so that the initial size of the structure 20 is reduced until the frame members 40 and panels are collapsed on each other (see FIG. 3C) to provide for a small essentially compact configuration having a plurality of concentric frame members 40 and layers of the panels 22, 24, 26, 28 so that the collapsed structure 20 has a size which is a fraction of the size of the initial structure.

Figure 5:
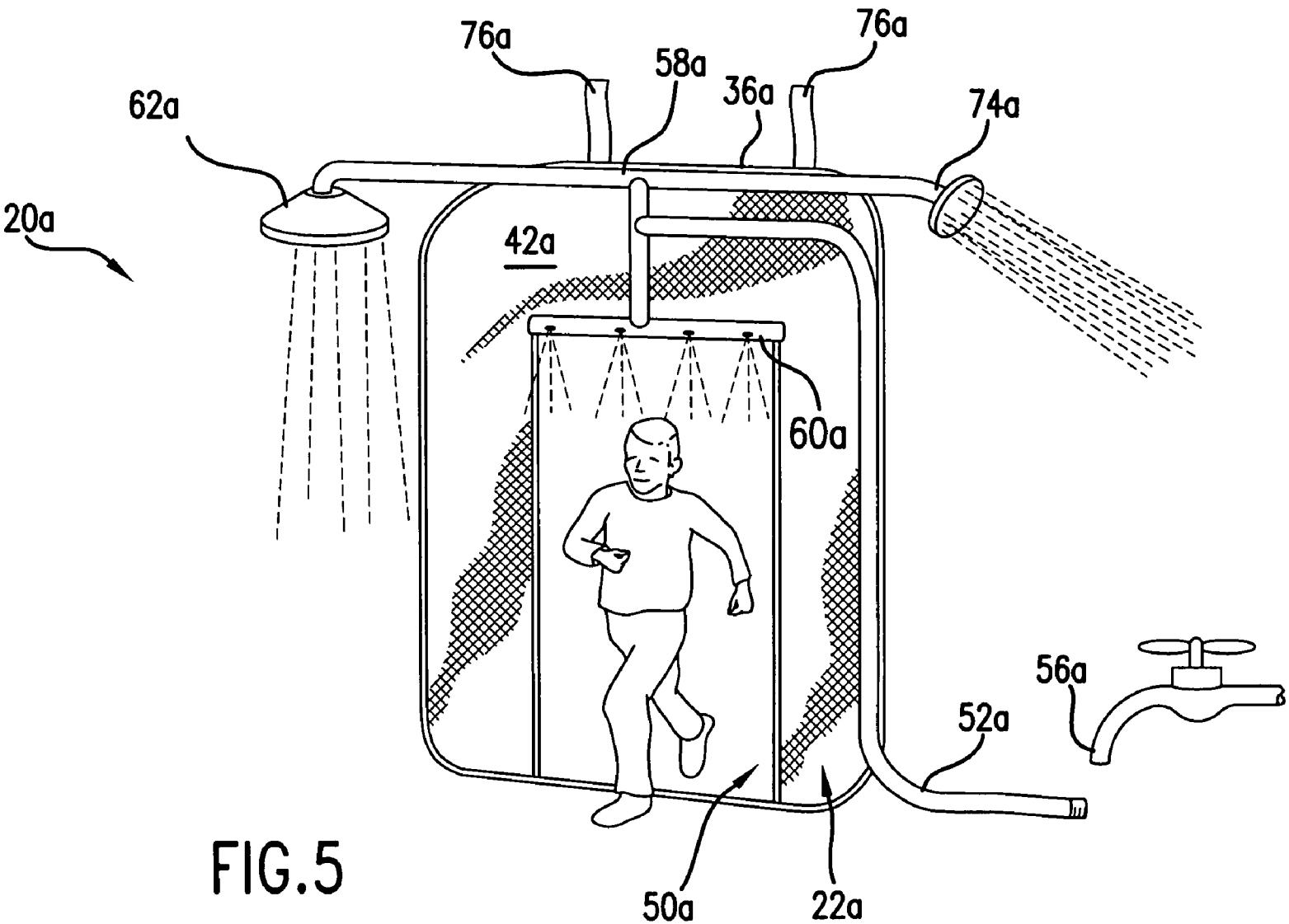
FIGS. 5-6 illustrate other embodiments of collapsible structures according to the present invention.

FIG. 5 illustrates a modification of the structure 20, where the new structure 20*a* is essentially comprised of the panel 22*a*, and the other panels 24, 26, 28 are omitted. The panel 22*a* and its fabric 42*a*, opening 50*a*, tube 52*a*, tube 58*a*, shower head 62*a* and shower outlet 60*a* can be the same as the corresponding panel 22 and its fabric 42, opening 50, tube 52, tube 58, shower head 62 and shower outlet 60. The structure 20*a* further includes another shower outlet 74*a*, and two hanging straps 76*a* attached to the top side 36*a*. The straps 76*a* allow the panel 22*a* to be suspended from the top edge of an open door, from the branches of a tree, or any other support member that would allow the panel 22*a* to be suspended in a vertical manner. The panel 22*a* can be folded and collapsed in the same manner as described above in connection with FIGS. 3A-3C. As with the structure 20, the structure 20*a* allows for a collapsible structure to incorporate water use or water play, where the ability of the structure 20, 20*a* to be reduced in size for storage promotes convenience and ease of storage.

Figure 6:
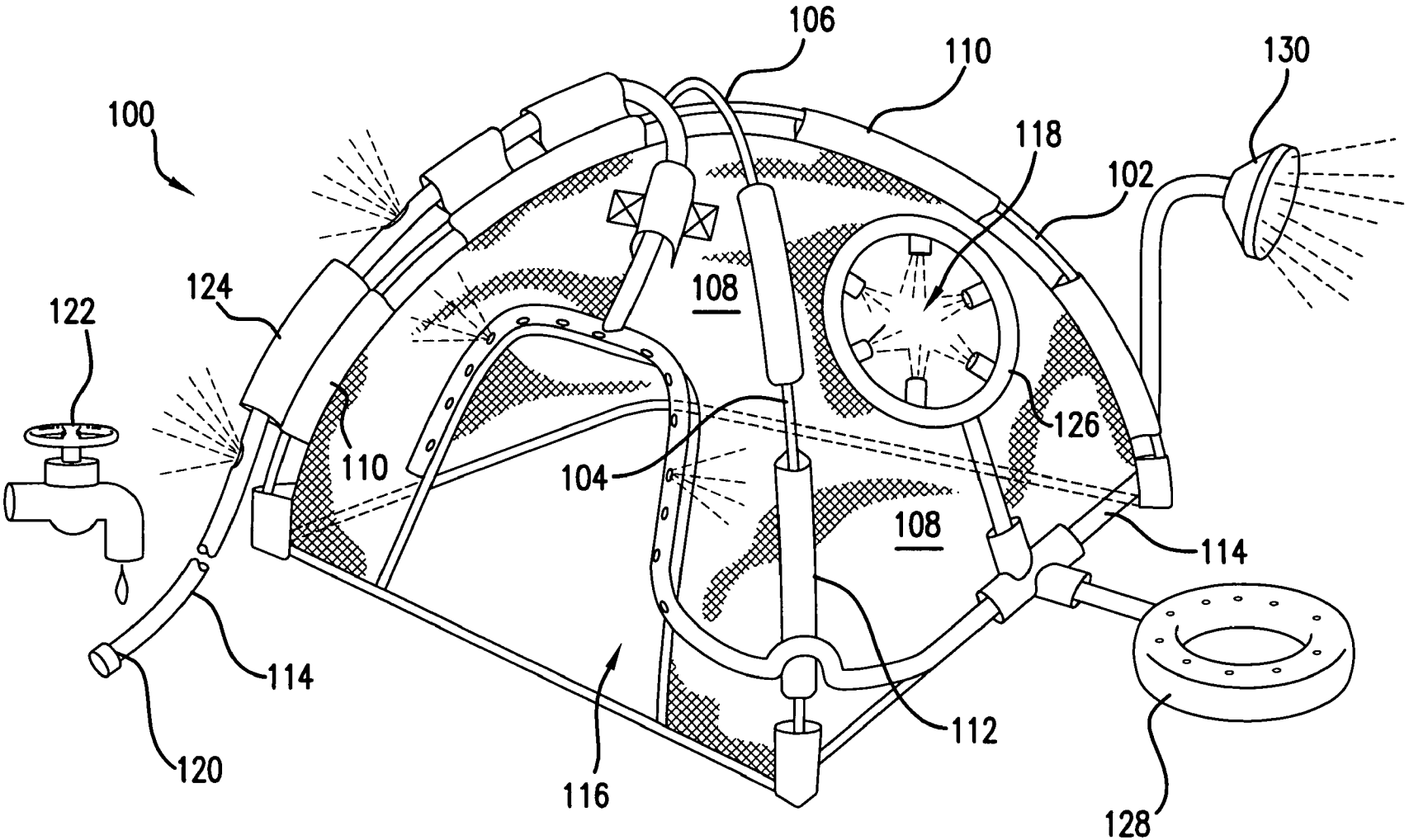

FIG. 6 extends the principles of FIGS. 1-5 to different types of collapsible structures. In FIG. 6, the structure 100 does not have separate panels 22, but is instead made up of two crossing frame members 102, 104 that can be made of the same material as the frame member 40 described above. The frame members 102, 104 cross at an apex 106, and their respective ends are secured to the ground or surface, so as to form a domed or apexed configuration for the structure 100. Fabric material, which is provided in the form of a shell 108, is removably attached to the frame members 102, 104 to form an enclosing structure. Frame retaining sleeves 110 and 112 can be stitched to the fabric shell 108 to retain the frame members 102 and 104, respectively. Openings 116 and 118 similar to the openings 48, 50 can be provided in the fabric shell 108, and tubes 114 can be attached to the fabric shell 108 or the sleeves 110, 112 to form tubing systems. For example, the tube 114 can have an end 120 that is adapted to be connected to a water faucet 122. The tube 114 can be partially housed in its own sleeve 124 which is attached to (e.g., by stitching) and extends along the sleeve 110, and then extends along the fabric shell 108 around the opening 116, then along the bottom edge of the fabric shell 108 where it branches in three directions: towards a tubing section 126 (having spray holes) that encircles the opening 118, towards a spray ring 128, and towards a shower head 130. The tube 114 can be made from the same material as the tube 52. The structure 100 can be disassembled by removing and separating the frame members 102 and 104, and then folding the fabric shell 108. Since the tube 114 is flexible and soft, it can be folded together with the fabric shell 108.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A structure, comprising:

at least one foldable continuous steel frame member having a folded and an unfolded orientation, with a fabric material covering portions of the frame member to form at least one panel when the frame member is in the unfolded orientation, wherein the frame member is twisted and folded to its folded orientation where the frame member is comprised of a plurality of concentric frame members;

a water tube attached to the fabric material and connected to a water supply, the water tube made from a soft tubular material and assumes a folded orientation when the frame member is twisted and folded;

a water outlet coupled to the water tube; and an opening provided in the fabric material, with the water tube extending continuously around the border of the opening, and the water outlet directs water at the opening.

2. The structure of claim 1, wherein the water tube is removably attached to the fabric material.

3. The structure of claim 1, wherein the at least one panel comprises four panels that are connected to form an enclosed space.

4. The structure of claim 3, wherein the at least one foldable steel frame member comprises four separate frame members, with each of the separate frame members defining each of the four panels.

5. The structure of claim 1, further including a frame retaining sleeve for retaining the frame member.

6. The structure of claim 5, wherein a portion of the water tube is coupled to the frame retaining sleeve.

7. The structure of claim 1, wherein the at least one frame member is continuous and enclosed.

8. The structure of claim 1, wherein the at least one panel comprises a plurality of separate panels that are hingedly coupled to each other.

* * * * *